US008770172B2

(12) United States Patent
Hashizume et al.

(10) Patent No.: US 8,770,172 B2
(45) Date of Patent: Jul. 8, 2014

(54) FUEL SHORTAGE DETECTING APPARATUS FOR GENERAL-PURPOSE ENGINE

(75) Inventors: Takashi Hashizume, Wako (JP); Masayuki Fukuhara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 347 days.

(21) Appl. No.: 13/218,913

(22) Filed: Aug. 26, 2011

(65) Prior Publication Data

US 2012/0055446 A1 Mar. 8, 2012

(30) Foreign Application Priority Data

Sep. 8, 2010 (JP) ..... 2010-201469
Sep. 8, 2010 (JP) ..... 2010-201470

(51) Int. Cl.
*F02D 45/00* (2006.01)
*F02D 41/22* (2006.01)

(52) U.S. Cl.
USPC ..... 123/349; 123/357; 123/359

(58) Field of Classification Search
USPC ..... 123/198 C, 198 D, 349, 497, 509, 516, 123/399, 257, 359
See application file for complete search history.

(56) References Cited

U.S. PATENT DOCUMENTS 4,292,620 A * 9/1981 Pagane ..... 180/287
4,602,605 A * 7/1986 Adkins ..... 123/516
4,776,315 A * 10/1988 Greiner ..... 123/509
4,899,706 A * 2/1990 Sasaki ..... 123/198 D
4,960,088 A * 10/1990 Havemann et al. ..... 123/198 D
5,095,880 A * 3/1992 Ricks ..... 123/516
5,103,783 A * 4/1992 Hanson et al. ..... 123/198 D
5,283,548 A * 2/1994 Kanno ..... 340/439
5,691,692 A * 11/1997 Herbstritt ..... 340/438
6,253,741 B1 * 7/2001 Channing ..... 123/516
6,253,742 B1 * 7/2001 Wickman et al. ..... 123/516
6,588,449 B1 * 7/2003 Kippe ..... 137/399
6,871,629 B2 * 3/2005 Hanson et al. ..... 123/198 C (Continued)

FOREIGN PATENT DOCUMENTS

JP 61-19944 A 1/1986
JP 6-81740 A 3/1994

(Continued)

OTHER PUBLICATIONS

Notice of Allowance issued in Japanese Application No. 2010-201469, dated Aug. 28, 2013, 4 pages.

(Continued)

*Primary Examiner* — Hieu T Vo
*Assistant Examiner* — Arnold Castro
(74) *Attorney, Agent, or Firm* — Arent Fox LLP

(57) ABSTRACT

In an apparatus for detecting fuel shortage of a general-purpose internal combustion engine connectable to an operating machine to be used as a prime mover of the machine, the engine being supplied with fuel stored in a tank and having an actuator adapted to open and close a throttle valve installed in an air intake pipe so as to achieve a desired engine speed set by an operator, comprising a fuel shortage condition detector adapted to detect whether the engine is in a fuel shortage condition, and an engine stopper adapted to stop the engine when the engine is detected to be in the fuel shortage condition. With this, it becomes possible to detect whether the engine having the electronic governor is in the fuel shortage condition, thereby preventing occurrence of trouble such as afterburning.

26 Claims, 8 Drawing Sheets

(56) References Cited

U.S. PATENT DOCUMENTS

| | | | | |
|---|---|---|---|---|
| 7,487,761 | B1 * | 2/2009 | Culbertson et al. | 123/497 |
| 2008/0047522 | A1 * | 2/2008 | Leisner et al. | 123/198 D |
| 2012/0055446 | A1 * | 3/2012 | Hashizume et al. | 123/349 |

FOREIGN PATENT DOCUMENTS

| | | | |
|---|---|---|---|
| JP | 9-166036 | A | 6/1997 |
| JP | 3053597 | U | 11/1998 |
| JP | 2004-285892 | A | 10/2004 |
| JP | 2006-329095 | A | 12/2006 |
| JP | 2007-2715 | A | 1/2007 |
| JP | 2009-8031 | A | 1/2009 |

OTHER PUBLICATIONS

Office Action issued in Japanese Application No. 2010-201469, dated Jul. 10, 2013, 4 pages.

Office Action issued in Japanese Application No. 2010-201470, dated Jun. 19, 2013, 3 pages.

* cited by examiner

FUEL SHORTAGE DETECTING APPARATUS FOR GENERAL-PURPOSE ENGINE

BACKGROUND

1. Technical Field

The embodiments relate to a fuel shortage detecting apparatus for a general-purpose internal combustion engine, particularly to an apparatus for detecting or determining whether fuel of the engine runs out, thereby preventing afterburning and the like.

2. Background Art

A general-purpose engine used as a prime mover of an industrial small operating machine for agricultural, constructional and other use is equipped with a manipulation switch (main switch) installed to be manipulated by the operator (user) and configured to be started upon turning on the switch and stopped upon turning off the switch so that a stop command is inputted to stop the fuel supply, as taught, for example, in Japanese Laid-Open Patent Application No. 2007-002715.

SUMMARY

As in the foregoing, the engine is immediately stopped once the switch is turned off. However, when the fuel is short or deficient (runs out), i.e., it is under a fuel shortage condition, the behavior of the engine becomes unstable before being stopped. It may cause unstable engine speed and also afterburning or backfire.

Specifically, in the case of a general-purpose engine having an actuator, i.e., so-called electronic governor, for opening/closing a throttle valve installed in an air intake pipe to achieve a desired engine speed set by the operator, the insufficient fuel supply leads to the decrease in the engine speed and the throttle opening is increased accordingly. As a result, the regulation of fuel (air/fuel ratio) becomes unstable on the extremely lean side, so that the aforementioned disadvantage is remarkable.

An object of the embodiments is therefore to overcome the foregoing problem by providing a fuel shortage detecting apparatus for a general-purpose engine that can detect or determine whether the engine having the electronic governor is in the fuel shortage condition, thereby preventing occurrence of trouble such as afterburning.

In order to achieve the object, the embodiment provides in its first aspect an apparatus for detecting fuel shortage of a general-purpose internal combustion engine connectable to an operating machine to be used as a prime mover of the machine, the engine being supplied with fuel stored in a tank and having an actuator adapted to open and close a throttle valve installed in an air intake pipe so as to achieve a desired engine speed set by an operator, comprising: a fuel shortage condition detector adapted to detect whether the engine is in a fuel shortage condition; and an engine stopper adapted to stop the engine when the engine is detected to be in the fuel shortage condition.

In order to achieve the object, the embodiment provides in its second aspect a method for detecting fuel shortage of a general-purpose internal combustion engine connectable to an operating machine to be used as a prime mover of the machine, the engine being supplied with fuel stored in a tank and having an actuator adapted to open and close a throttle valve installed in an air intake pipe so as to achieve a desired engine speed set by an operator, comprising the steps of:

detecting whether the engine is in a fuel shortage condition; and stopping the engine when the engine is detected to be in the fuel shortage condition.

BRIEF DESCRIPTION OF DRAWINGS

The above and other objects and advantages will be more apparent from the following description and drawings in which.

DESCRIPTION OF EMBODIMENTS

A fuel shortage detecting apparatus for a general-purpose engine according to an embodiment will now be explained with reference to the attached drawings.

Figure 1:
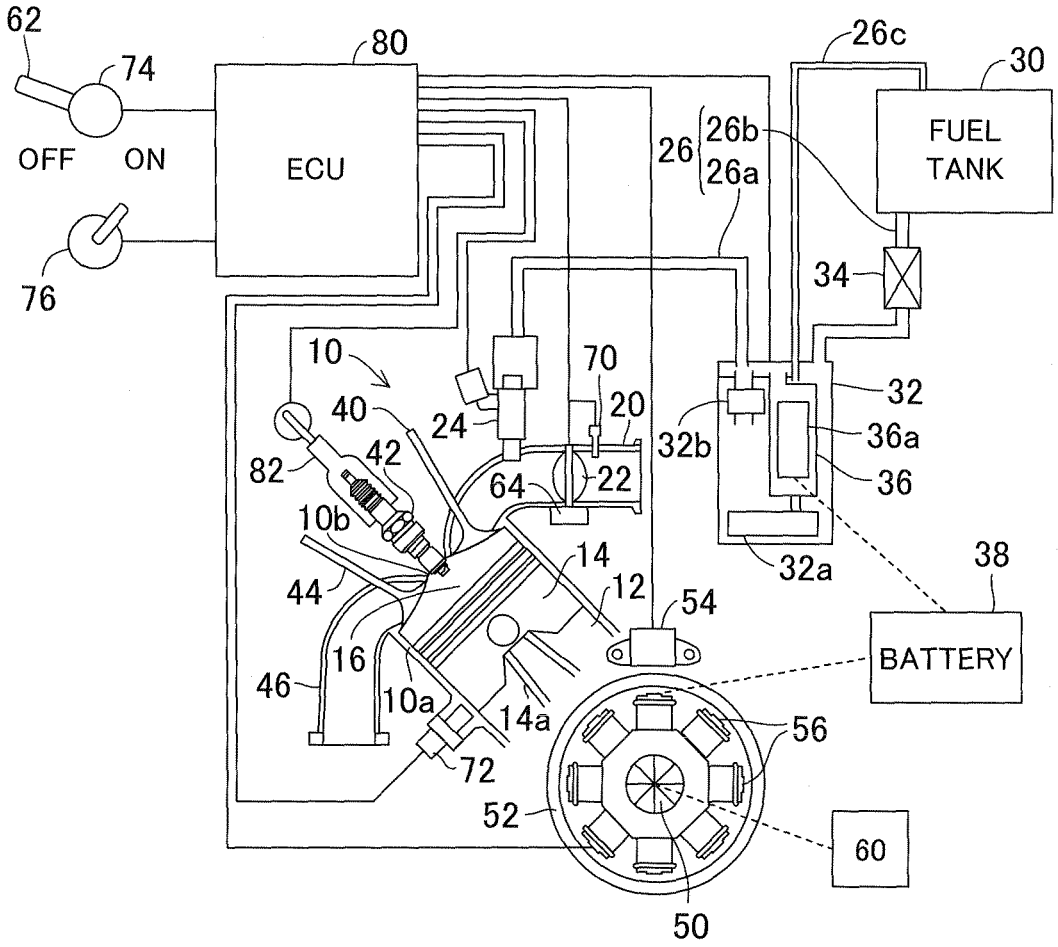
FIG. 1 is an overall view schematically showing a fuel shortage detecting apparatus for a general-purpose engine according to a first embodiment.

In FIG. 1, reference numeral 10 designates a general-purpose engine (general-purpose internal combustion engine). The engine 10 is a gasoline-injection, single-cylinder, air-cooled, four-cycle, OHV engine with a displacement of, for example, 400 cc. The engine 10 comprises a general-purpose internal combustion engine usable as a prime mover of (connectable to) an industrial small operating machine for agricultural, constructional and other use.

A cylinder 12 formed in a cylinder block 10*a* of the engine 10 accommodates a piston 14 that reciprocates therein. A cylinder head 10*b* is attached to the cylinder block 10*a* and a combustion chamber 16 is formed between the cylinder head 10*b* and the crown of the piston 14.

The combustion chamber 16 is connected to an air intake pipe 20. The air intake pipe 20 is installed with a throttle valve 22 and at the downstream thereof, further installed with an injector 24 near an intake port. The injector 24 is connected to a fuel tank 30 through a fuel supply pipe 26.

To be more specific, the injector 24 is connected to a sub fuel tank 32 through a first fuel supply pipe 26*a* and the sub fuel tank 32 is connected to the fuel tank 30 through a second fuel supply pipe 26*b*.

The second fuel supply pipe 26*b* is interposed with a low-pressure pump 34 to pump fuel (gasoline) stored in the fuel tank 30 to be forwarded to the sub fuel tank 32. The sub fuel tank 32 is installed with a fuel pump (high-pressure pump) 36.

The fuel pump 36 has an electric motor 36*a* in its interior. The motor 36*a* is connected to a battery (power source) 38 and operated upon the supply of current therefrom to pressurize the fuel forwarded by the low-pressure pump 34 and filtered through a filter 32*a*.

While being regulated by a regulator 32*b*, the pressurized fuel is pumped to the injector 24 through the fuel supply pipe 26*a*. A part of the fuel in the sub fuel tank 32 is returned to the fuel tank 30 through a return pipe 26*c*. Thus the engine 10 connected to a fuel supply system including the fuel supply pipe 26, fuel tank 30, sub fuel tank 32, fuel pump 36, etc., is supplied with gasoline as fuel from the system to be operated.

The intake air sucked through an air cleaner (not shown) is flown through the air intake pipe 20. After the flow rate is regulated by the throttle valve 22, the intake air reaches the intake port and is mixed with the fuel injected from the injector 24 to form the air-fuel mixture.

When an intake valve 40 is opened, the air-fuel mixture is flown into the combustion chamber 16 and ignited by a spark plug 42 to burn, thereby driving the piston 14. When an exhaust valve 44 is opened, the exhaust gas produced through the combustion is flown through an exhaust pipe 46, muffler (not shown), etc., and discharged to the exterior.

A crankcase (not shown) is attached to the cylinder block 10*a* on the side opposite from the cylinder head 10*b* and houses a crankshaft 50 to be rotatable therein. The crankshaft 50 is connected to the piston 14 through a connecting rod 14*a* and rotated with the movement of the piston 14.

A camshaft (not shown) is rotatably housed in the crankcase to be parallel with the crankshaft 50 and connected via a gear mechanism (not shown) to the crankshaft 50 to be driven thereby. The camshaft is equipped with an intake cam and exhaust cam to open/close the intake valve 40 and exhaust valve 44 through a push rod and rocker arms (neither shown).

One end of the crankshaft 50 is attached with a flywheel 52. A pulsar coil (crank angle sensor) 54 is attached to the crankcase outside the flywheel 52. The pulsar coil 54 is rotated relative to a magnet (permanent magnet piece; not shown) attached on a top surface of the flywheel 52 and crosses the flux of the magnet, so that it produces one output per one rotation (360 degrees) of the crankshaft 50 at a predetermined crank angle near the top dead center.

Power coils (generator coils) 56 are attached in the inside of the crankcase and are rotated relative to eight magnets (permanent magnet piece; not shown) attached on a back surface of the flywheel 52 to produce electromotive forces by crossing the flux of the magnets. Thus the power coils 56 function as an Alternating-Current Generator (ACG). The produced electromotive force is rectified and then supplied to the battery 38 to charge it.

The other end of the crankshaft 50 is connected to a load 60 such as an operating machine. In the embodiments, a term of "load" means a machine or equipment that consumes power or energy (output) generated by a prime mover, or an amount or magnitude of power consumed by the machine.

An accelerator lever 62 is installed at an appropriate position on a housing (not shown) of the engine 10 to be manipulated by the operator (user). The lever 62 comprises a knob to be pinched by the operator's fingers, so that the operator can input a command for establishing a desired engine speed by turning the knob within a range between predefined minimum and maximum engine speeds.

The throttle valve 22 is connected to an electric motor (actuator, more exactly, a stepper motor) 64. The motor 64 opens/closes or regulates the throttle valve 22 independently from the manipulation of the accelerator lever 62 by the operator. Specifically, the throttle valve 22 is of a Drive-By-Wire type.

An intake air temperature sensor 70 comprising a thermistor or the like is installed in the air intake pipe 20 at the upstream of the throttle valve 22 and produces an output or signal indicative of a temperature of intake air flowing therethrough. An engine temperature sensor 72 comprising a thermistor or the like is installed at the cylinder block 10*a* and produces an output or signal indicative of a temperature of the installed position, i.e., a temperature of the engine 10.

A variable resistor (potentiometer) 74 is connected to the accelerator lever 62 to produce an output or signal representing the desired engine speed desired by the operator. A manipulation switch (main switch) 76 to be manipulated by the operator is installed at an appropriate position on the housing of the engine 10.

The manipulation switch 76 produces an output or signal indicating an operation command such as an engine start command when being manipulated to an ON position (made ON) by the operator and a stop command when being manipulated to an OFF position (made OFF).

The outputs of the foregoing sensors 70, 72, 74, switch 76, pulsar coil 54 and power coils 56 are sent to an Electronic Control Unit (ECU) 80 comprising a microcomputer having a CPU, ROM, RAM and input/output circuits.

The ECU 80 detects the engine speed based on the output of the pulsar coil 54 and controls the opening operation of the injector 24, the driving operation of the fuel pump 36, etc., the driving operation of the motor 64, and other operation based on the outputs of the other sensors. The engine speed may be detected based on the outputs of the power coils 56.

As for the operation of the motor 64, the ECU 80 instructs or determines it in response to the manipulation of the accelerator lever 62 by the operator, i.e., calculates an opening of the throttle valve 22 (throttle opening) that can establish the desired engine speed set by the operator and sends a command for achieving the calculated throttle opening to the motor 64 through a drive circuit (not shown). Hence, the engine 10 according to the embodiments includes an electronic governor having the motor 64, ECU 80, etc.

Since the ECU 80 instructs a rotational amount of the motor 64, it can calculate or detect the throttle opening based on a command value produced by itself, without a throttle opening sensor. The throttle opening is calculated by obtaining a percentage when defining the fully-closed position or thereabout as 0 and the fully-opened position or thereabout as 100.

In relation to valve opening operation of the injector 24, the fuel injection control is explained. The ECU 80 calculates a fuel injection amount by retrieving mapped values (characteristics) set beforehand using at least the calculated throttle opening and the engine speed detected from the output of the pulsar coil 54, i.e., by using a method called a throttle speed method.

The fuel injection amount is calculated from the injection time (opening time) of the injector 24. When the engine 10 is started, the retrieved value from the mapped values is corrected with the detected engine temperature and when the intake air temperature is greatly varied, the retrieved value is corrected with the detected intake air temperature.

Next, the ignition control is explained. The ECU 80 calculates the ignition timing based on appropriate parameters and controls the ignition operation of the spark plug 42 through an ignition device 82 such as an ignition coil. The fuel injection and ignition operation are carried out in response to the output of the pulsar coil 54.

Further, as mentioned above, the ECU 80 determines the desired engine speed in accordance with the manipulation of the accelerator lever 62, calculates the throttle opening to achieve the determined desired engine speed, and calculates the fuel injection amount based on at least the calculated throttle opening and detected engine speed.

The ECU 80 carries out the above determination of the desired engine speed, calculation of the throttle opening, detection of the engine speed, calculation of the fuel injection amount, calculation of an amount of current supply to the motor 36*a* of the pump 36, etc., at predetermined intervals, e.g., 10 milliseconds, and holds or stores the results thereof during predetermined multiple control cycles. The ECU 80 executes the above operation when the manipulation switch 76 is made ON by the operator and stops or finishes the operation when it is made OFF.

Further, the ECU 80 detects or determines a fuel shortage condition of the engine 10 and conducts the stop operation thereof.

Figure 2:
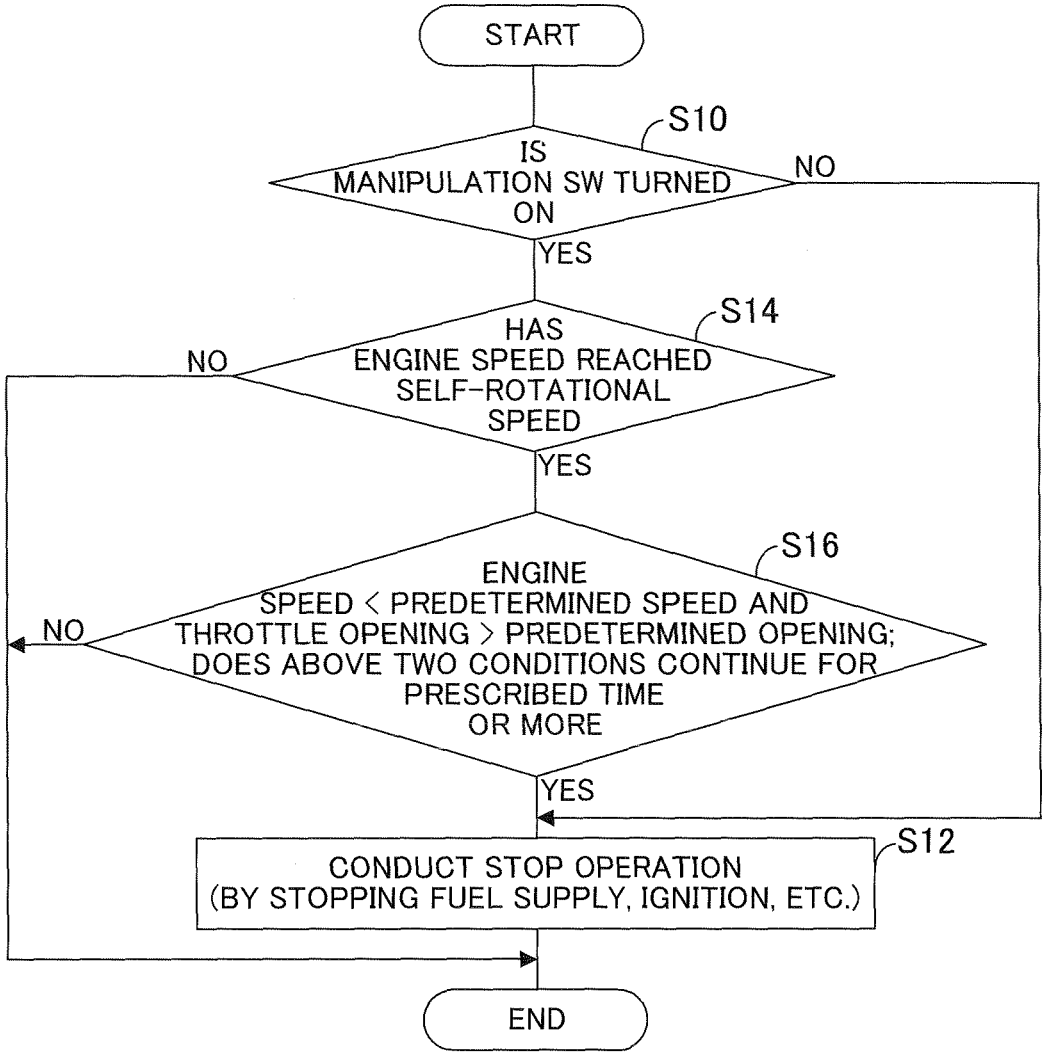
FIG. 2 is a flowchart showing fuel shortage condition detection and stop operation conducted by the apparatus shown in FIG. 1.

FIG. 2 is a flowchart showing the fuel shortage condition detection and stop operation of the engine 10.

The program begins at S(step)10, in which it is determined whether the manipulation 76 is turned on by the operator. When the result is negative, the program proceeds to S12 to conduct the stop operation of the engine 10. Specifically, the normal stop operation is conducted.

To be more specific, in S12, the fuel supply (fuel injection) through the injector 24 is stopped or (and) the ignition through the ignition device 82 and spark plug 42 is stopped, thereby stopping the engine 10.

Further, in S12, instead of (in addition to) stopping the fuel supply/ignition, the engine 10 may be stopped by driving the throttle valve 22 to a stop opening position through the motor 64 or by stopping the pump 36 (i.e., the motor 36*a* thereof).

Since the ECU 80 executes the processing in the FIG. 2 flowchart upon turn-ON of the manipulation switch 74 by the operator, when the operator turns ON the switch 74 once and then turns it OFF to input the stop command, the result in S10 is negative and the program proceeds to S12, in which the normal stop operation is conducted.

When the result in S10 is affirmative, the program proceeds to S14, in which it is determined whether the engine speed has reached the self-rotational speed, in other words, whether the start operation of the engine 10 has been completed.

When the result in S14 is negative, since it means that the engine 10 is still in its start operation, the remaining steps are skipped and when the result is affirmative, the program proceeds to S16, in which it is determined whether the detected engine speed is less than a predetermined speed (e.g., 1500 rpm), i.e., in a low speed condition and the throttle opening is greater than a predetermined opening (e.g., 90%), i.e., in a wide-open throttle condition, and it is also determined whether the low speed condition and wide-open throttle condition continue for a prescribed time (e.g., 100 milliseconds) or more.

Figure 3:
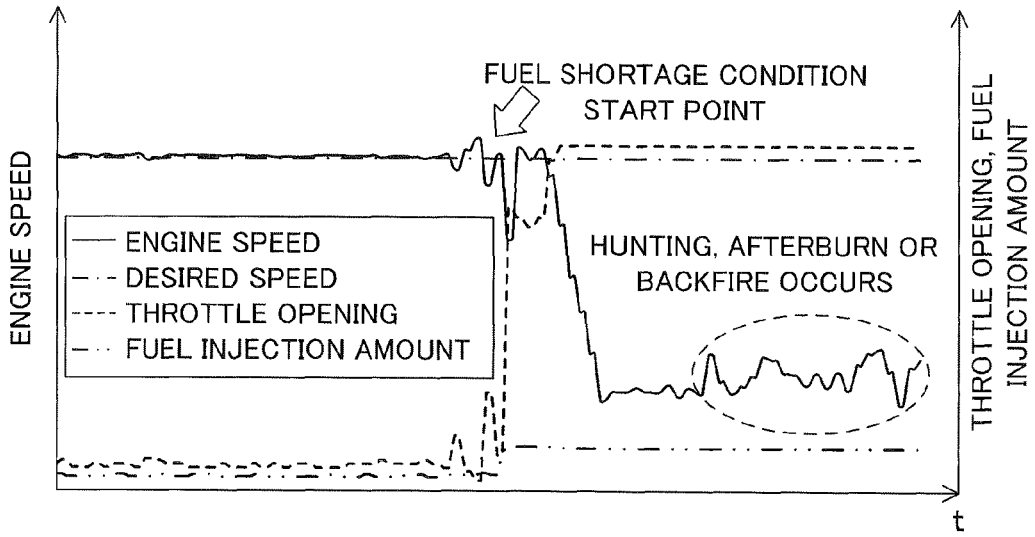
FIG. 3 is a time chart showing the operation of the engine when the processing of FIG. 2 is not conducted by the apparatus shown in FIG. 1.

FIG. 3 is a time chart showing the operation of the engine 10 when the processing of FIG. 2 is not conducted by the apparatus shown in FIG. 1.

As indicated by "fuel shortage condition start point" in the drawing, when the gasoline (fuel) becomes short or deficient (runs out), i.e., it is in the fuel shortage condition, it makes impossible to supply the gasoline through the fuel pump 36 and air enters into the fuel supply pipe 26, so that an amount of fuel supply to the engine 10 becomes insufficient and unstable and it destabilizes the combustion in the combustion chamber 16.

Consequently, the engine 10 can not maintain the desired engine speed and the engine speed becomes unstable (hunting occurs) as illustrated. Also, since the throttle opening is sharply increased with decreasing engine speed, the fuel regulation becomes unstable on the extremely lean side. Further, when fire breaks out, unburned gas is flown into the exhaust pipe 46 and muffler and it causes afterburning or backfire.

Returning to the explanation on the FIG. 2 flowchart, the determination of S16 amounts to determining whether it is in the fuel shortage condition, as is clear from the explanation for FIG. 3.

Therefore, when the result in S16 is affirmative, i.e., when it is determined that the low-speed condition and wide-open throttle condition continue for the prescribed time or more, it is determined to be in the fuel shortage condition and the program proceeds to S12, in which the aforementioned normal stop operation is conducted.

Specifically, the fuel supply (fuel injection) through the injector 24 is stopped or (and) the ignition through the ignition device 82 and spark plug 42 is stopped, thereby stopping the engine 10. When the result in S16 is negative, the remaining steps are skipped.

Figure 4:
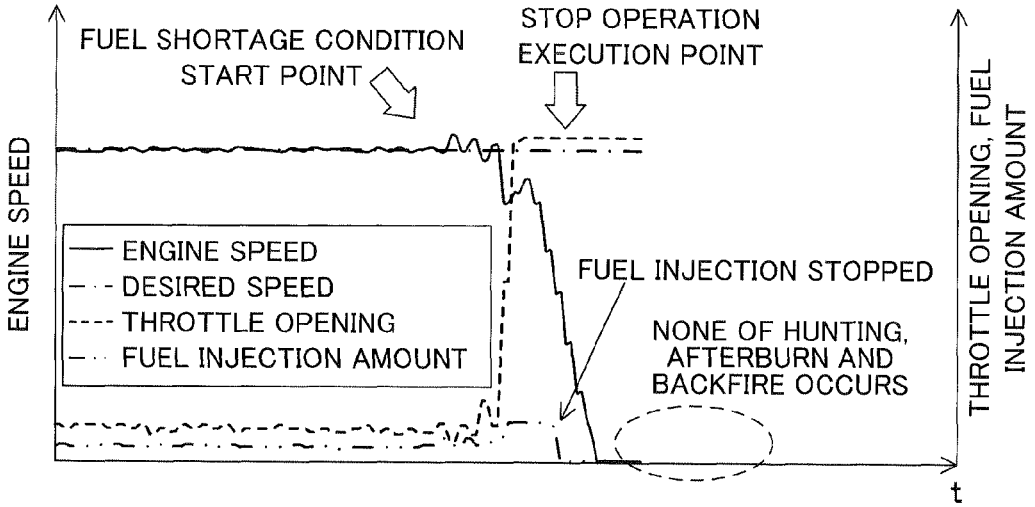
FIG. 4 is a time chart showing the operation of the engine when the processing of FIG. 2 is conducted by the apparatus shown in FIG. 1.

FIG. 4 is a time chart showing the operation of the engine 10 when the processing of FIG. 2 is conducted by the apparatus shown in FIG. 1.

As clearly seen in FIG. 4, when it is determined to be in the fuel shortage condition, the normal stop operation is conducted right at a stop operation execution point even if the manipulation switch 76 is not turned OFF, so that the engine speed is sharply decreased accordingly, without becoming unstable. Thus, owing to the above operation, it becomes possible to stop the engine 10 without causing afterburning or backfire.

As stated above, the first embodiment is configured to have a fuel shortage condition detector adapted to detect whether the engine 10 is in a fuel shortage condition (S16) and an engine stopper adapted to stop the engine when the engine is detected to be in the fuel shortage condition (S12). Since the fuel shortage condition is detected in the general-purpose engine 10 having the electronic governor, even when the manipulation switch 76 is not turned OFF, it becomes possible to prevent the engine speed from becoming unstable and avoid a trouble like afterburning or backfire.

Further, since the normal stop operation is conducted and it means that the engine stop operation is conducted before the fuel supply pipe 26 is filled with air, the operation to purge the air is not necessary when the fuel is refilled next time, thereby improving the next start-up performance.

In the apparatus, the fuel shortage condition detector detects whether a speed of the engine is in a low-speed condition where it is less than a predetermined speed (e.g., 1500 rpm) and an opening of the throttle valve 22 is in a wide-open throttle condition where it is greater than a predetermined opening (e.g., 90%) and whether the low-speed condition and the wide-open throttle condition continue for a prescribed time (e.g., 100 milliseconds) or more, and detects that the engine is in the fuel shortage condition when the low-speed condition and the wide-open throttle condition are detected to continue for the prescribed time or more (S16). With this, in addition to the above effects, it becomes possible to accurately determine whether the engine 10 is out of fuel.

The apparatus further includes a manipulation switch 76 installed to be manipulated by the operator to produce an output indicative of start/stop of the engine, and the fuel shortage condition detector detects whether the engine is in the fuel shortage condition (S16) after the manipulation switch was turned on and start operation of the engine has been completed (S10, S14). With this, in addition to the above effects, it becomes possible to avoid misjudging the unstable condition of the engine 10 at the engine start or the like as the fuel shortage condition.

In the apparatus, the engine stopper stops the engine by stopping supply of the fuel (S12). With this, in addition to the above effects, it becomes possible to reliably stop the engine 10.

In the apparatus, the engine stopper stops the engine by stopping ignition. With this, in addition to the above effects, it becomes possible to reliably stop the engine 10.

A fuel shortage detecting apparatus for a general-purpose internal combustion engine according to a second embodiment will be next explained.

Figure 5:
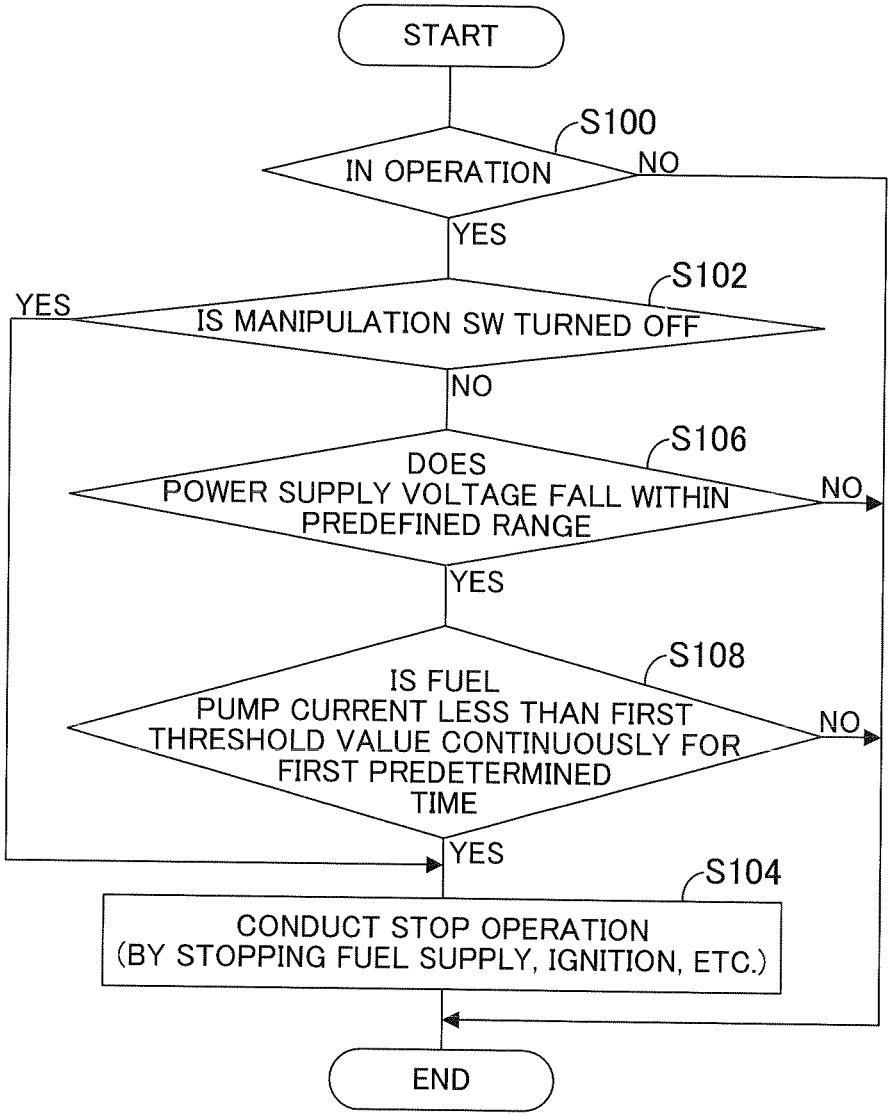
FIG. 5 is a flowchart showing fuel shortage condition detection and stop operation conducted by a fuel shortage detecting apparatus for a general-purpose engine according to a second embodiment.

FIG. 5 is a flowchart showing fuel shortage condition determining processing and stop operation conducted by the apparatus according to the second embodiment.

First, in S100, it is determined whether the engine 10 is in operation, i.e., it is in operation upon turn-ON of the manipulation switch 76. This determination is made by checking as to whether the engine speed exceeds a prescribed speed (e.g., 1000 rpm).

When the result in S100 is negative, the remaining steps are skipped and when the result is affirmative, the program proceeds to S102, in which it is determined whether the switch 76 is turned OFF. When the result in S102 is affirmative, the program proceeds to S104, in which the engine stop operation, i.e., the normal stop operation of the engine 10 through turn-OFF of the switch 76 is conducted.

Specifically, in S104, similarly to S12 in the first embodiment, the fuel supply (fuel injection) through the injector 24 is stopped or (and) the ignition through the ignition device 82 and spark plug 42 is stopped, thereby stopping the engine 10.

Further, in S104, instead of (in addition to) stopping the fuel supply/ignition, the engine 10 may be stopped by driving the throttle valve 22 to a stop opening position through the motor 64 or by stopping the current supply to the motor 36*a* of the pump 36.

When the result in S102 is negative, the program proceeds to S106, in which it is determined whether power supply voltage falls within a predefined range, i.e., whether the voltage of the battery 38 falls within the predefined range (e.g., 14.5V±1.0V). This determination is made by detecting the voltage of the battery 38 by a voltage sensor (not shown).

When the result in S106 is negative, the change in the battery voltage causes the change in the current supply to the motor 36*a* of the pump 36 and it may lead to erroneous detection of fuel shortage condition (explained later). Therefore, the remaining steps are skipped.

When the result in S106 is affirmative, the program proceeds to S108, in which a fuel pump current, i.e., a current value supplied to the motor 36*a* of the pump 36 (supply current value) is compared with a first fuel shortage detection threshold value (hereinafter called the "first threshold value"; e.g., 0.7 A) and also determined whether the fuel pump current (supply current value) is less than the first threshold value continuously for a first predetermined time (e.g., 100 milliseconds).

When the result in S108 is negative, the remaining steps are skipped and when the result is affirmative, i.e., when the fuel pump current (supply current value) is determined to be less than the first threshold value continuously for the first predetermined time, it is discriminated that the engine 10 is in the fuel shortage condition where the fuel is short (runs out) and the program proceeds to S104, in which the normal stop operation of the engine 10 is conducted.

Specifically, the fuel supply (fuel injection) through the injector 24 is stopped or (and) the ignition through the ignition device 82 and spark plug 42 is stopped, thereby stopping the engine 10. When the result in S16 is negative, the remaining steps are skipped.

Thus, in S108, based on the operation of the fuel pump 36, more exactly based on the current value supplied to the motor 36*a* of the pump 36, whether or not the engine 10 is in the fuel shortage condition is detected and when it is detected to be in the fuel shortage condition, the engine 10 is stopped.

Figure 6:
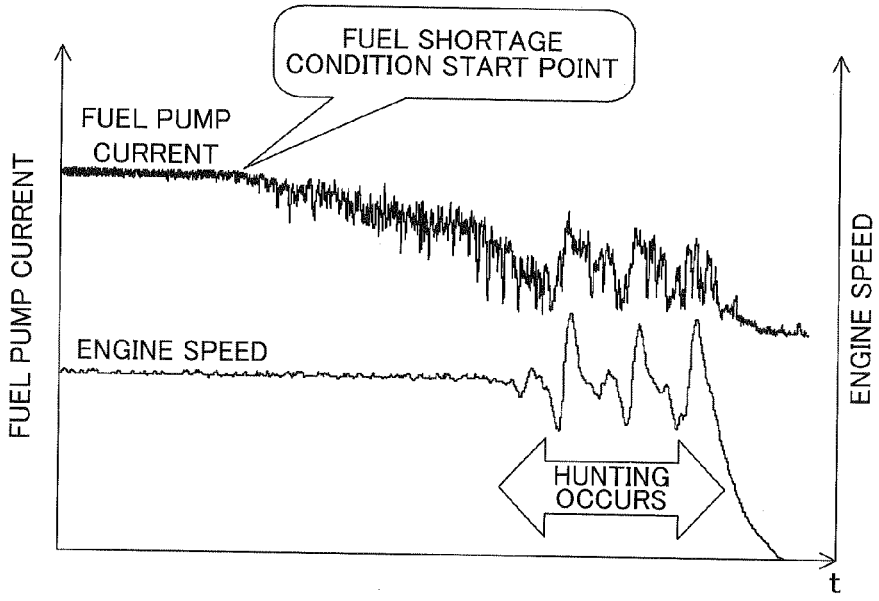
FIG. 6 is a time chart showing the operation of the engine when the processing of FIG. 5 is not conducted by the apparatus shown in FIG. 1.

FIG. 6 is a time chart showing the operation of the engine 10 when the processing of FIG. 5 is not conducted by the apparatus shown in FIG. 1.

When the fuel becomes short (the fuel shortage condition starts) at a point of "fuel shortage condition start point" in the figure, the fuel supply is decreased and load of the motor 36*a* of the pump 36 is decreased accordingly, so that the current value supplied to the motor 36*a* is decreased.

After a while the fuel supply is stopped. Since air bubbles are scattered in the fuel supply pipe 26, the load of the motor 36*a* of the pump 36 is greatly varied and the fuel flow rate and fuel pressure become insufficient, whereby the fuel regulation does not go well and it destabilizes the engine speed (hunting occurs) as illustrated.

In addition, although not illustrated, since the throttle opening is sharply increased with decreasing engine speed, the fuel regulation becomes unstable on the extremely lean side. Further, when fire breaks out, unburned gas is flown through the exhaust pipe 46 and muffler and it causes afterburning or backfire.

Figure 7:
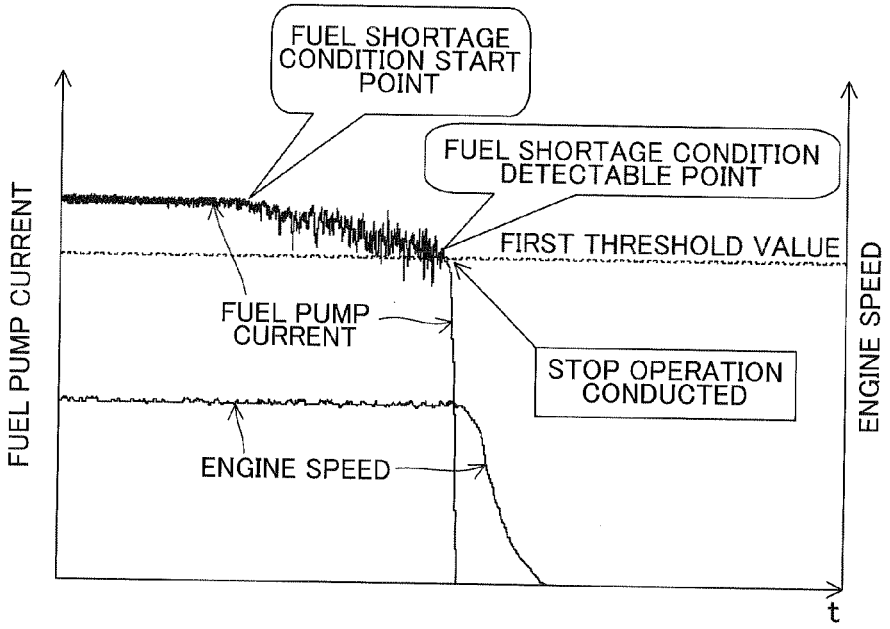
FIG. 7 is a time chart showing the operation of the engine when the processing of FIG. 5 is conducted by the apparatus shown in FIG. 1.

FIG. 7 is a time chart showing the operation of the engine 10 when the processing of FIG. 5 is conducted by the apparatus shown in FIG. 1.

As clearly seen in FIG. 7, when the engine 10 is determined to be in the fuel shortage condition, the stop operation is conducted at a fuel shortage condition detectable point and therefore, even if the manipulation switch 76 is not turned OFF, the engine speed is sharply decreased through the immediate normal stop operation, without becoming unstable. Thus, owing to the above operation of the FIG. 5 flowchart, it becomes possible to stop the engine 10 without causing afterburning or backfire.

As stated above, the second embodiment is configured such that the fuel shortage condition detector detects that the engine 10 is in the fuel shortage condition based on operation of the fuel pump 36, i.e., based on a current value supplied to the motor 36*a* of the fuel pump 36, more precisely when the current value is less than a first fuel shortage detection threshold value (first threshold value) continuously for a first predetermined time (S108). With this, in the general-purpose engine 10 having the electronic governor, even when the manipulation switch 76 is not turned OFF, it becomes possible to prevent the engine speed from becoming unstable and avoid a trouble like afterburning or backfire.

Further, since whether or not the engine 10 is in the fuel shortage condition is detected based on the operation of the pump 36, the fuel shortage condition of the engine 10 can be easily discriminated. Also, since the normal stop operation can be conducted even in the fuel shortage condition and it means that the engine stop operation is conducted before the fuel supply pipe 26 is filled with air, the operation to purge the air is not necessary when the fuel is refilled next time, thereby improving the next start-up performance.

In the apparatus, the fuel shortage condition detector detects whether the engine is in the fuel shortage condition when the voltage of the battery (power supply) 38 falls within the predetermined range. With this, it becomes possible to accurately determine whether the engine 10 is short and out of fuel.

It should be noted that, in S108, although the determination accuracy slightly degrades, it may configure to compare the current value supplied to the motor 36*a* with the first threshold value and when it is less than the threshold value, determine that the engine 10 is in the fuel shortage condition.

The remaining configuration and effects are the same as those in the first embodiment.

A fuel shortage detecting apparatus for a general-purpose internal combustion engine according to a third embodiment will be next explained.

Figure 8:
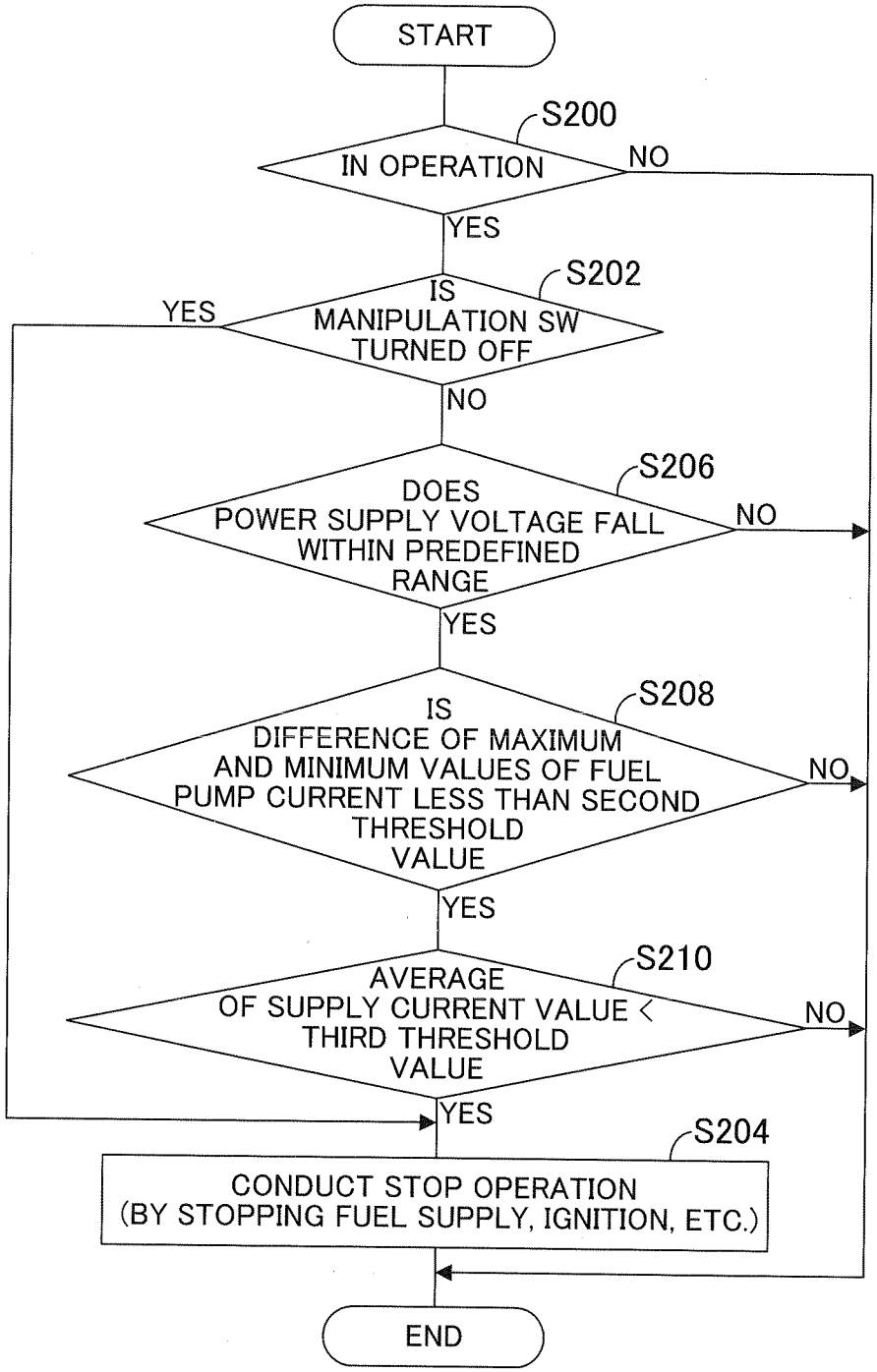
FIG. 8 is a flowchart showing fuel shortage condition detection and stop operation conducted by a fuel shortage detecting apparatus for a general-purpose engine according to a third embodiment.

FIG. 8 is a flowchart similar to FIG. 5, but showing fuel shortage condition detection and stop operation conducted by the apparatus according to the third embodiment.

The processing of S200 to S206 is conducted similarly to S100 to S106 in the second embodiment, whereafter the program proceeds to S208, in which it is determined whether a difference between the maximum and minimum values of the current value supplied to the motor 36*a* of the fuel pump 36, i.e., a variation width thereof is greater than a second fuel shortage detection threshold value (hereinafter called the "second threshold value"; e.g., 0.3 A).

This determination is made based on the premise that, as mentioned in the second embodiment, when the fuel runs out, the air enters into the fuel supply pipe 26 so that the load of the motor 36*a* of the pump 36 is greatly varied and consequently, the variation width of the supply current value is increased.

The variation width of the supply current value is obtained by calculating the difference between its maximum and minimum values during a second predetermined time. Since the supply current value is calculated at intervals of 10 milliseconds, when the second predetermined time is defined as 500 milliseconds, the variation width is obtained by selecting the maximum and minimum values among 50 supply current values and calculating the difference therebetween.

When the result in S208 is negative, the remaining steps are skipped and when the result is affirmative, the program proceeds to S210, in which it is determined whether the current value supplied to the motor 36*a*, i.e., an average of the supply current value during a third predetermined time (e.g., 500 milliseconds) is less than a third fuel shortage detection threshold value (hereinafter called the "third threshold value"; e.g., 1.6 A).

This determination is made also based on the premise that, as mentioned in the second embodiment, when the fuel runs out, the air enters into the fuel supply pipe 26 that is originally filled with the fuel and the load of the motor 36*a* of the pump 36 is decreased accordingly, so that the current value supplied to the motor 36*a* is decreased. The third embodiment is configured to make determination by two steps, thereby improving the fuel shortage detection accuracy.

When the result in S210 is negative, the remaining steps are skipped and when the result is affirmative, it is discriminated that the engine 10 is in the fuel shortage condition and the program proceeds to S204, in which, similarly to S104, the normal stop operation of the engine 10 is conducted.

Figure 9:
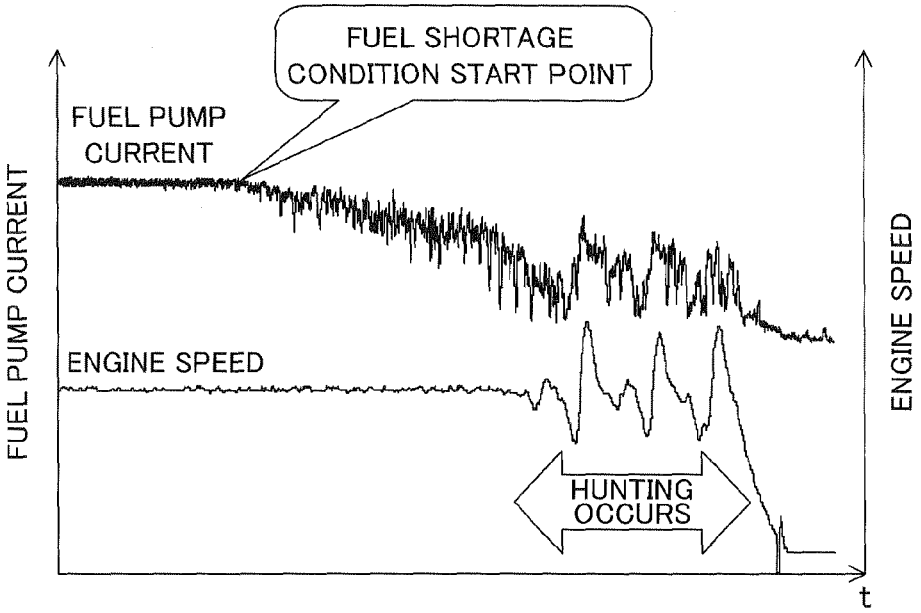
FIG. 9 is a time chart showing the operation of the engine when the processing of FIG. 8 is not conducted by the apparatus shown in FIG. 1.
Figure 10:
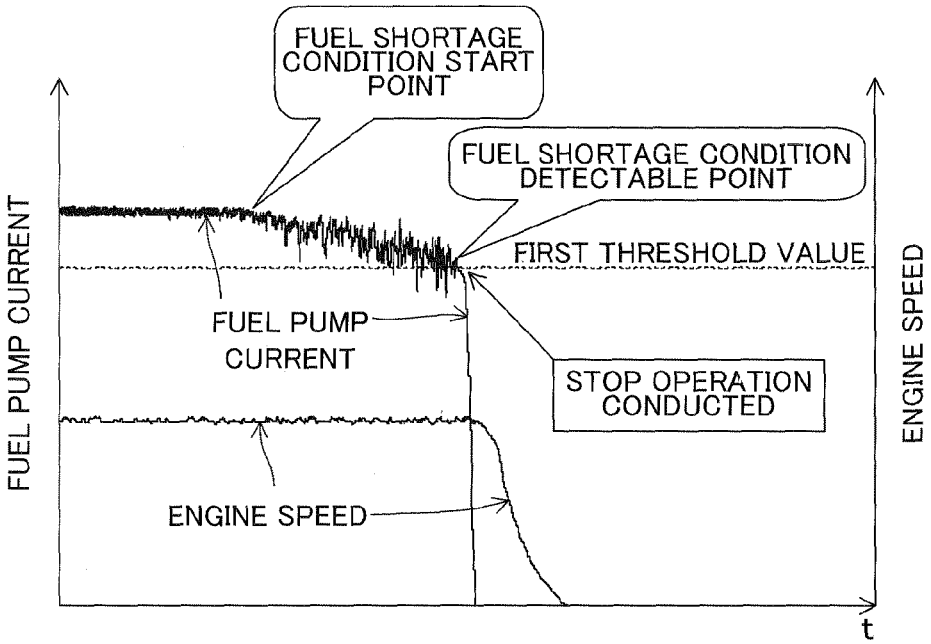
FIG. 10 is a time chart showing the operation of the engine when the processing of FIG. 8 is conducted by the apparatus shown in FIG. 1.

FIG. 9 is a time chart showing the operation of the engine 10 when the processing of FIG. 8 is not conducted and FIG. 10 is a time chart thereof when it is conducted.

As is clear from a comparison of FIG. 9 to FIG. 10, also in the third embodiment, when the engine 10 is determined to be in the fuel shortage condition, the stop operation is conducted at the fuel shortage condition detectable point and therefore, even if the manipulation switch 76 is not turned OFF, the engine speed is sharply decreased through the immediate normal stop operation. Thus, it becomes possible to stop the engine 10 without causing afterburning or backfire.

As stated above, the third embodiment is configured to detect that the engine 10 is in the fuel shortage condition when a variation width of the current value supplied to the motor 36*a* of the fuel pump 36 is greater than a second fuel shortage detection threshold value (second threshold value) and the current value is less than a third fuel shortage detection threshold value (third threshold value), more exactly, when the variation width of the current value supplied to the motor 36*a* of the fuel pump 36 during a second predetermined time is greater than the second threshold value and an average of the current value during a third predetermined time is less than the third threshold value. With this, in the general-purpose engine 10 having the electronic governor, even when the manipulation switch 76 is not turned OFF, it becomes possible to prevent the engine speed from becoming unstable and avoid a trouble like afterburning or backfire.

Further, since whether or not the engine 10 is in the fuel shortage condition is detected based on the operation of the pump 36, the fuel shortage condition of the engine 10 can be easily detected. Also, since the normal stop operation can be conducted even in the fuel shortage condition and it means that the engine stop operation is conducted before the fuel supply pipe 26 is filled with air, the operation to purge the air is not necessary when the fuel is refilled next time, thereby improving the next start-up performance.

The remaining configuration and effects are the same as those in the second embodiment.

It should be noted that, in S208 and S210, although the determination accuracy slightly degrades, it may configure to determine that the engine 10 is in the fuel shortage condition when the variation width of the current value supplied to the motor 36*a* is greater than the second threshold value and the supply current value is less than the third threshold value, without taking the second and third predetermined times into account.

A fuel shortage detecting apparatus for a general-purpose internal combustion engine according to a fourth embodiment will be next explained.

Figure 11:
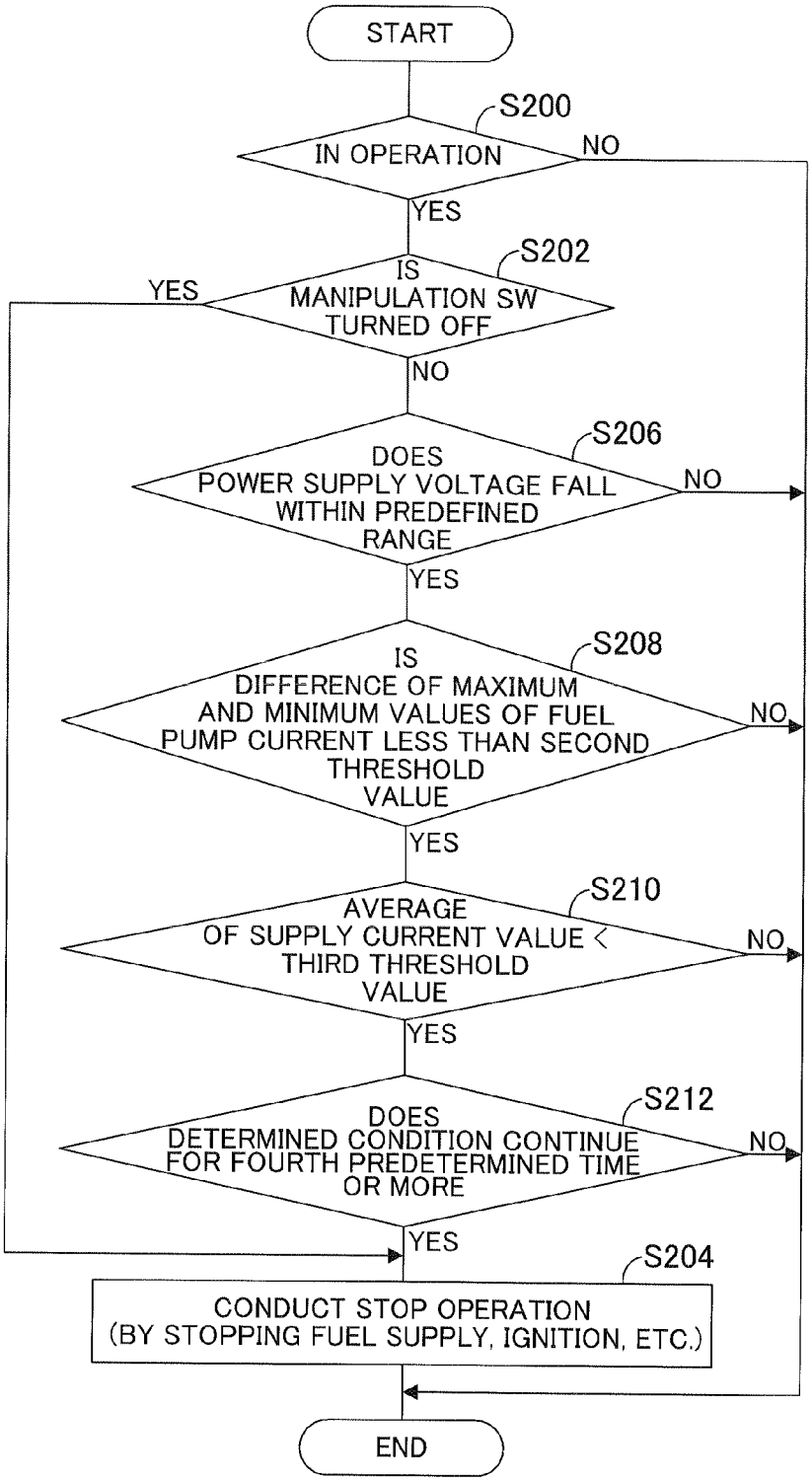
FIG. 11 is a flowchart showing fuel shortage condition detection and stop operation conducted by a fuel shortage detecting apparatus for a general-purpose engine according to a fourth embodiment.

FIG. 11 is a flowchart similarly to FIG. 5, but showing fuel shortage condition detection and stop operation conducted by the apparatus according to the fourth embodiment.

The processing of S200 to S210 is conducted similarly to the third embodiment. When the result in S210 is negative, the remaining steps are skipped and when the result is affirmative, the program proceeds to S212, in which it is determined whether the condition determined in (and before) S210 continues for a fourth predetermined time (e.g., 100 milliseconds) or more.

To be more specific, it is determined whether the variation width of the current value supplied to the motor 36*a* during the second predetermined time is greater than the second threshold value continuously for the fourth predetermined time and the average of the supply current value during the third predetermined time is less than the third threshold value continuously for the fourth predetermined time.

When the result in S212 is negative, the remaining steps are skipped and when the result is affirmative, it is discriminated that the engine 10 is in the fuel shortage condition and the program proceeds to S204, in which the normal stop operation of the engine 10 is conducted.

As stated above, the fourth embodiment is configured such that the fuel shortage condition detector detects that the engine 10 is in the fuel shortage condition when the variation width of the current value supplied to the motor 36*a* of the fuel pump 36 during the second predetermined time is greater than the second threshold value continuously for a fourth predetermined time and the average of the current value during the third predetermined time is less than the third threshold value continuously for the fourth predetermined time. With this, similarly to the third embodiment, in the general-purpose engine 10 having the electronic governor, even when the manipulation switch 76 is not turned OFF, it becomes possible to prevent the engine speed from becoming unstable and avoid a trouble like afterburning or backfire.

The remaining configuration and effects are the same as those in the foregoing embodiments.

As mentioned in the foregoing, the first to fourth embodiments are configured to have an apparatus and a method for detecting fuel shortage of a general-purpose internal combustion engine 10 connectable to an operating machine (load 60) to be used as a prime mover of the machine, the engine being supplied with fuel stored in a tank (fuel tank) 30 and having an actuator (electric motor) 64 adapted to open and close a throttle valve 22 installed in an air intake pipe 20 so as to achieve a desired engine speed set by an operator, comprising: a fuel shortage condition detector (ECU 80, S16, S108, S208, S210, S212) adapted to detect whether the engine is in a fuel shortage condition; and an engine stopper (ECU 80, S12, S104, S204) adapted to stop the engine when the engine is detected to be in the fuel shortage condition.

Since the fuel shortage condition is detected in the general-purpose engine 10 having the electronic governor, even when the manipulation switch 76 is not turned OFF, it becomes possible to prevent the engine speed from becoming unstable and avoid a trouble like afterburning or backfire.

Further, since the normal stop operation is conducted and it means that the engine stop operation is conducted before the fuel supply pipe 26 is filled with air, the operation to purge the air is not necessary when the fuel is refilled next time, thereby improving the next start-up performance.

In the first embodiment, the fuel shortage condition detector detects whether a speed of the engine is in a low-speed condition where it is less than a predetermined speed (e.g., 1500 rpm) and an opening of the throttle valve is in a wide-open throttle condition where it is greater than a predetermined opening (90%) and whether the low-speed condition and the wide-open throttle condition continue for a prescribed time (100 milliseconds) or more, and detects that the engine is in the fuel shortage condition when the low-speed condition and the wide-open throttle condition are detected to continue for the prescribed time or more. With this, in addition to the above effects, it becomes possible to accurately detect whether the engine 10 is in the fuel shortage condition.

The apparatus further includes a manipulation switch 76 installed to be manipulated by the operator to produce an output indicative of start/stop of the engine, and the fuel shortage condition detector detects whether the engine is in the fuel shortage condition (ECU 80, S16) after the manipulation switch was turned on and start operation of the engine has been completed (ECU 80, S10, S14). With this, in addition to the above effects, it becomes possible to avoid misjudging the unstable condition of the engine 10 at the engine start or the like as the fuel shortage condition.

In the apparatus according to the first to fourth embodiments, the engine stopper stops the engine by stopping supply of the fuel (ECU 80, S12, S104, S204). With this, in addition to the above effects, it becomes possible to reliably stop the engine 10.

In the apparatus, the engine stopper stops the engine by stopping ignition (ECU 80, S12, S104, S204). With this, in addition to the above effects, it becomes possible to reliably stop the engine 10.

In the apparatus according to the second to fourth embodiments, the engine is connected to a fuel supply system (fuel supply pipe 26, fuel tank 30, sub fuel tank 32, fuel pump 36, etc.) having a fuel pump 36 operated by an electric motor 36*a* to pump the fuel stored in the tank 30 to be supplied to the engine and the fuel shortage condition detector detects whether the engine is in the fuel shortage condition based on operation of the fuel pump (ECU 80, S108, S208, S210, S212). With this, in the general-purpose engine 10 having the electronic governor, even when the manipulation switch 76 is not turned OFF, it becomes possible to prevent the engine speed from becoming unstable and avoid a trouble like afterburning or backfire.

Further, since whether or not the engine 10 is in the fuel shortage condition is detected based on the operation of the pump 36, the fuel shortage condition of the engine 10 can be easily discriminated.

In the apparatus, the fuel shortage condition detector detects whether the engine is in the fuel shortage condition based on a current value supplied to the motor 36*a* of the fuel pump 36. With this, in addition to the above effects, it becomes possible to accurately detect whether the engine 10 is in the fuel shortage condition.

In the apparatus according to the second embodiment, the fuel shortage condition detector compares the current value supplied to the motor 36*a* of the fuel pump 36 with a first (fuel shortage detection) threshold value and detects that the engine is in the fuel shortage condition when the current value is less than the first threshold value (ECU 80, S108). With this, in addition to the above effects, it becomes possible to accurately detect whether the engine 10 is in the fuel shortage condition.

In the apparatus, the fuel shortage condition detector compares the current value supplied to the motor 36*a* of the fuel pump 36 with the first threshold value and detects that the engine is in the fuel shortage condition when the current value is less than the first threshold value continuously for a first predetermined time (ECU 80, S108). With this, in addition to the above effects, it becomes possible to accurately detect whether the engine 10 is in the fuel shortage condition.

In the apparatus according to the third and fourth embodiments, the fuel shortage condition detector detects that the engine is in the fuel shortage condition when a variation width of the current value supplied to the motor of the fuel pump is greater than a second (fuel shortage detection) threshold value and the current value is less than a third (fuel shortage detection) threshold value (ECU 80, S208, S210). With this, in addition to the above effects, it becomes possible to further accurately detect whether the engine 10 is in the fuel shortage condition.

In the apparatus, the fuel shortage condition detector detects that the engine is in the fuel shortage condition when the variation width of the current value supplied to the motor 36*a* of the fuel pump 36 during a second predetermined time is greater than the second threshold value and an average of the current value during a third predetermined time is less than the third threshold value. With this, in addition to the above effects, it becomes possible to further accurately detect whether the engine 10 is in the fuel shortage condition.

In the apparatus according to the fourth embodiment, the fuel shortage condition detector detects that the engine is in the fuel shortage condition when the variation width of the current value supplied to the motor 36*a* of the fuel pump 36 during the second predetermined time is greater than the second threshold value continuously for a fourth predetermined time and the average of the current value during the third predetermined time is less than the third threshold value continuously for the fourth predetermined time. With this, in addition to the above effects, it becomes possible to further accurately detect whether the engine 10 is in the fuel shortage condition.

In the apparatus according to the second to fourth embodiments, the fuel shortage condition detector detects whether power supply voltage (voltage of the battery 38) falls within a predetermined range and detects whether the engine is in the fuel shortage condition when the power supply voltage falls within the predetermined range (ECU 80, S106, S206). With this, in addition to the above effects, it becomes possible to avoid erroneous detection of fuel shortage condition caused by the change of current supplied to the motor 36*a* of the pump 36 with the change in the battery voltage, thereby further accurately detecting the fuel shortage condition of the engine 10.

It should be noted that, although the threshold values, predetermined speed, predetermined opening, prescribed time, predetermined times, etc., are indicated with specific values in the foregoing, they are only examples and not limited thereto. Further, although the general-purpose engine operated using gasoline as fuel is exemplified, the above embodiments can be applied to a general-purpose engine operated using light oil, etc.

Japanese Patent Application Nos. 2010-201469 and 2010-201470, both filed on Sep. 8, 2010, are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for detecting fuel shortage of a general-purpose internal combustion engine connectable to an operating machine to be used as a prime mover of the machine, the engine being supplied with fuel stored in a tank and having an actuator adapted to open and close a throttle valve installed in an air intake pipe so as to achieve a desired engine speed set by an operator, comprising:

a fuel shortage condition detector adapted to detect whether the engine is in a fuel shortage condition; and an engine stopper adapted to stop the engine when the engine is detected to be in the fuel shortage condition, wherein the fuel shortage condition detector detects whether the engine is in the fuel shortage condition based on a speed of the engine and an opening of the throttle valve.

2. The apparatus according to claim 1, wherein the fuel shortage condition detector detects whether the speed of the engine is in a low-speed condition where it is less than a predetermined speed and the opening of the throttle valve is in a wide-open throttle condition where it is greater than a predetermined opening and whether the low-speed condition and the wide-open throttle condition continue for a prescribed time or more, and detects that the engine is in the fuel shortage condition when the low-speed condition and the wide-open throttle condition are detected to continue for the prescribed time or more.

3. The apparatus according to claim 1, further including:

a manipulation switch installed to be manipulated by the operator to produce an output indicative of start/stop of the engine, and the fuel shortage condition detector detects whether the engine is in the fuel shortage condition after the manipulation switch was turned on and start operation of the engine has been completed.

4. The apparatus according to claim 1, wherein the engine stopper stops the engine by stopping supply of the fuel.

5. The apparatus according to claim 1, wherein the engine stopper stops the engine by stopping ignition.

6. An apparatus for detecting fuel shortage of a general-purpose internal combustion engine connectable to an operating machine to be used as a prime mover of the machine, the engine being supplied with fuel stored in a tank and having an actuator adapted to open and close a throttle valve installed in an air intake pipe so as to achieve a desired engine speed set by an operator, comprising:

a fuel shortage condition detector adapted to detect whether the engine is in a fuel shortage condition; and an engine stopper adapted to stop the engine when the engine is detected to be in fuel shortage condition, wherein the engine is connected to a fuel supply system having a fuel pump operated by an electric motor to pump the fuel stored in the tank to be supplied to the engine and the fuel shortage condition detector detects whether the engine is in the fuel shortage condition based on operation of the fuel pump.

7. The apparatus according to claim 6, wherein the fuel shortage condition detector detects whether the engine is in the fuel shortage condition based on a current value supplied to the motor of the fuel pump.

8. The apparatus according to claim 7, wherein the fuel shortage condition detector compares the current value supplied to the motor of the fuel pump with a first threshold value and detects that the engine is in the fuel shortage condition when the current value is less than the first threshold value.

9. The apparatus according to claim 8, wherein the fuel shortage condition detector compares the current value supplied to the motor of the fuel pump with the first threshold value and detects that the engine is in the fuel shortage condition when the current value is less than the first threshold value continuously for a first predetermined time.

10. The apparatus according to claim 7, wherein the fuel shortage condition detector detects that the engine is in the fuel shortage condition when a variation width of the current value supplied to the motor of the fuel pump is greater than a second threshold value and the current value is less than a third threshold value.

11. The apparatus according to claim 10, wherein the fuel shortage condition detector detects that the engine is in the fuel shortage condition when the variation width of the current value supplied to the motor of the fuel pump during a second predetermined time is greater than the second threshold value and an average of the current value during a third predetermined time is less than the third threshold value.

12. The apparatus according to claim 11, wherein the fuel shortage condition detector detects that the engine is in the fuel shortage condition when the variation width of the current value supplied to the motor of the fuel pump during the second predetermined time is greater than the second threshold value continuously for a fourth predetermined time and the average of the current value during the third predetermined time is less than the third threshold value continuously for the fourth predetermined time.

13. The apparatus according to claim 6, wherein the fuel shortage condition detector detects whether power supply voltage falls within a predetermined range and detects whether the engine is in the fuel shortage condition when the power supply voltage falls within the predetermined range.

14. A method for detecting fuel shortage of a general-purpose internal combustion engine connectable to an operating machine to be used as a prime mover of the machine, the engine being supplied with fuel stored in a tank and having an actuator adapted to open and close a throttle valve installed in an air intake pipe so as to achieve a desired engine speed set by an operator, comprising the steps of:

detecting whether the engine is in a fuel shortage condition; and stopping the engine when the engine is detected to be in the fuel shortage condition, wherein the step of detecting detects whether the engine is in the fuel shortage condition based on a speed of the engine and an opening of the throttle valve.

15. The method according to claim 14, wherein the step of detecting detects whether the speed of the engine is in a low-speed condition where it is less than a predetermined speed and the opening of the throttle valve is in a wide-open throttle condition where it is greater than a predetermined opening and whether the low-speed condition and the wide-open throttle condition continue for a prescribed time or more, and detects that the engine is in the fuel shortage condition when the low-speed condition and the wide-open throttle condition are detected to continue for the prescribed time or more.

16. The method according to claim 14, wherein the step of detecting detects whether the engine is in the fuel shortage condition after the manipulation switch installed to be manipulated by the operator to produce an output indicative of start/stop of the engine was turned on and start operation of the engine has been completed.

17. The method according to claim 14, wherein the step of stopping stops the engine by stopping supply of the fuel.

18. The method according to claim 14, wherein the step of stopping stops the engine by stopping ignition.

19. A method for detecting fuel shortage of a general-purpose internal combustion engine connectable to an operating machine to be used as a prime mover of the machine, the engine being supplied with fuel stored in a tank and having an actuator adapted to open and close a throttle valve installed in an air intake pipe so as to achieve a desired engine speed set by an operator, comprising the steps of:

detecting whether the engine is in a fuel shortage condition; and stopping the engine when the engine is detected to be in the fuel shortage condition, wherein the engine is connected to a fuel supply system having a fuel pump operated by an electric motor to pump the fuel stored in the tank to be supplied to the engine and the step of detecting detects whether the engine is in the fuel shortage condition based on operation of the fuel pump.

20. The method according to claim 19, wherein the step of detecting detects whether the engine is in the fuel shortage condition based on a current value supplied to the motor of the fuel pump.

21. The method according to claim 20, wherein the step of detecting compares the current value supplied to the motor of the fuel pump with a first threshold value and detects that the engine is in the fuel shortage condition when the current value is less than the first threshold value.

22. The method according to claim 21, wherein the step of detecting compares the current value supplied to the motor of the fuel pump with the first threshold value and detects that the engine is in the fuel shortage condition when the current value is less than the first threshold value continuously for a first predetermined time.

23. The method according to claim 20, wherein the step of detecting detects that the engine is in the fuel shortage condition when a variation width of the current value supplied to the motor of the fuel pump is greater than a second threshold value and the current value is less than a third threshold value.

24. The method according to claim 23, wherein the step of detecting detects that the engine is in the fuel shortage condition when the variation width of the current value supplied to the motor of the fuel pump during a second predetermined time is greater than the second threshold value and an average of the current value during a third predetermined time is less than the third threshold value.

25. The method according to claim 24, wherein the step of detecting detects that the engine is in the fuel shortage condition when the variation width of the current value supplied to the motor of the fuel pump during the second predetermined time is greater than the second threshold value continuously for a fourth predetermined time and the average of the current value during the third predetermined time is less than the third threshold value continuously for the fourth predetermined time.

26. The method according to claim 19, wherein the step of detecting detects whether power supply voltage falls within a predetermined range and detects whether the engine is in the fuel shortage condition when the power supply voltage falls within the predetermined range.

* * * * *